US006166624A

United States Patent [19]

Hurst

[11] Patent Number: 6,166,624

[45] Date of Patent: Dec. 26, 2000

[54] PIEZOELECTRIC HORN, PARTICULARLY FOR VEHICLES

[75] Inventor: Gilbert Hurst, Sassey, France

[73] Assignee: Societe de Composants Electriques, France

[21] Appl. No.: 08/930,869

[22] PCT Filed: Apr. 3, 1996

[86] PCT No.: PCT/FR96/00498

§ 371 Date: Oct. 6, 1997

§ 102(e) Date: Oct. 6, 1997

[87] PCT Pub. No.: WO96/31869

PCT Pub. Date: Oct. 10, 1996

[30] Foreign Application Priority Data

Apr. 5, 1995 [FR] France ..... 95 04006

[51] Int. Cl.[7] ..... G08B 3/10

[52] U.S. Cl. ..... 340/384.6; 340/384.1; 340/388.1; 381/190; 381/191; 381/202

[58] Field of Search ..... 340/384.1, 384.4, 340/384.6, 384.73, 388.1, 388.4; 181/152, 159; 381/190, 191, 202

[56] References Cited

U.S. PATENT DOCUMENTS 4,767,959 8/1988 Sakakibara et al. ..... 310/317

FOREIGN PATENT DOCUMENTS 146933 3/1985 European Pat. Off. .
2 544 530 10/1984 France .
249826 3/1925 United Kingdom .

OTHER PUBLICATIONS

Nishiyama et al., "Piezoelectric Sound Component Used in Broad Range of Applications", JEE, Aug. 1988, Aug. 1990. 575 Nachrichtentechnik Elektronic 40 (1990) No. 12, Berlin.

*Primary Examiner*—Jeffery A. Hofsass
*Assistant Examiner*—Ashok Mannava
*Attorney, Agent, or Firm*—William A. Drucker

[57] ABSTRACT

A horn with a piezoelectric membrane including a ceramic disk adhered to a rectangular plate. A slotted ring made of light metal is rigidly attached to the edge of the plate and comprises sixteen radial projections uniformly distributed around its circumference. Each projection has an axially facing boss forming a stiffener. The membrane assembly is attached to a molded rubber membrane that is circular to make mounting easier. The membrane comprises a flexible wavy portion enabling free movement of the center. Two thin metal strips are embedded in the rubber of the membrane for establishing electrical contact with the ceramic disc and the metal plate respectively. The piezoelectric horn has a substantially reduced weight and power consumption relative to conventional electromagnetic horns.

11 Claims, 3 Drawing Sheets

PIEZOELECTRIC HORN, PARTICULARLY FOR VEHICLES

FIELD OF THE INVENTION

The present invention concerns sound horns, especially for the equipment of motor vehicles and more particularly concerns a piezoelectric sound horn.

BACKGROUND OF THE INVENTION

Sound horns currently equipping motor vehicles make use of the vibration of a membrane under the effect of an electromagnetic system. However, these electromagnetic sound horns, which are used on a world-wide scale, do have the drawback of being heavy (about 250 g) and consume a large amount of electricity (between 4 and 8 amps under a serviceable voltage of 12 V).

The aim of the present invention is to mitigate the drawbacks mentioned above of electromagnetic sound horns and to this effect concerns the embodiment of a piezoelectric horn, that is a sound horn using the vibration of a piezoelectric membrane.

This effect known as the <<piezoelectric effect >> is already known by which electrical charges appearing on the faces of certain crystals (quartz in particular) when the latter are subjected to mechanical stresses. As these crystals are generally nonconducting, the charges appearing on their faces give rise to electric voltages, possibly extremely high, and these electric voltages are picked up by metallic electrodes on the faces of the crystals.

This piezoelectric effect is reversible. If an electric voltage is applied it, this results in this crystal being mechanically deformed.

The piezoelectric effect is characteristic of the order structures of the material (crystals), but mono-crystaline materials are rare and scarcely suitable in use. However, certain ceramics have a crystalline type structure lending themselves also to the use of piezoelectric effects in consideration of a prior orientation of the molecules constituting the ceramic material. This orientation is obtained by applying for several seconds a high electric polarization field on the ceramic material, thus provoking the alignment of the molecules inside the ceramic material. On removal of the electric polarization field, the molecular orientation exists and gives rise to a piezoelectric phenomenon identical to the one observed in the monocrystals.

The polarized ceramics are much more suitable in use than the crystals and in fact are obtained in the desired shape by means of sintering at a high temperature and baking at more than 1000° C.

So as to produce sounds with the aid of a piezoelectric ceramic material, it has already been suggested to make use of a piezoelectric sound membrane formed of a thin metallic disk on which a piezoelectric ceramic disk is glued. A counter-electrode constituted by conductive ink is laid on the free surface of the ceramic disk and polarization is effected so that, when an alternative voltage is applied to the ceramic disk, the latter dilates or contracts diametrically. As these diameter modifications are set on one of its faces by the metallic membrane, everything is bent inward in the way of a bimetallic strip alternately in one direction and then in another, thus producing a vibration corresponding to the frequency of the excitation voltage.

So as to effectively use the piezoelectric membrane, the latter is mounted in a suitable support, this mounting device taking a significant part on the sound emission of the membrane in modifying the resonance frequencies of the membrane and more generally the frequency response of the device.

It is also known that this frequency response is likely to be modified by the use of flat non-circular metallic structures (especially rectangles) used instead of the thin metallic disk or in conjunction with the latter.

The piezoelectric membranes currently available on the market are solely used for low sound level applications. These applications mainly concern telephony, low level sound reproduction on portable devices, and also buzzers for industrial equipment and instrumentation, in particular motor vehicle buzzers (warning of neglecting to turn off the headlights, one door having remained open or an engine defect). The only applications with a sound level of more than 100 dbA concern either high frequency generators (1800 to 3600 Hz for car horns) or applications with a narrow frequency band and limited power (105 dB to 1000 Hz for reversing horns for lorries and engines).

These known types of low sound level buzzers of about between 70 and 90 dBA in a free field 10 cm away use small diameter piezoelectric membranes (generally less than 50 cm) having a resonance frequency of between 2 and 3 Khz.

This known conception of piezoelectric membrane buzzers, owing to its slight sound level, are unsuitable for the embodiment of sound horns for motor vehicles whose acoustic characteristics, established by the European Directive 70/388/CEE and by the recognized international agreement known under the designation <<Rule 28>>, need to be clearly much high-performing.

In fact, the sound level measured 2m away from the horn in a free field (on in a dead room) need to be between 105 dBA and 118 dBA and the sound level of this horn, once mounted on the vehicle, needs to be 93 dBA to 7 meters at the front of the vehicle.

Having regard to sound isolation, which increases in the vehicle engine compartment, this latter condition requires that the horn be adjusted to be as close as possible to the authorized maximum of 118 dBA, which has no relation with the 90 dBA measured 10 cm away obtained with the buzzers mentioned earlier which correspond to about 65 dBA measured 2 m away.

In addition, although this is not formally laid down, usage for sound horns consists of using frequencies of between 300 and 500 Hz which renders the sound devices used in the horns as being inadequate for a horn application.

SUMMARY OF THE INVENTION

The present invention concerns a new design and use of a piezoelectric sound element making it possible to embody a sound horn which fully satisfies the statutory conditions required and which, compared with conventional electromagnetic sound horns, has the advantage of its weight and electric consumption being reduced.

According to the invention, the piezoelectric sound horn includes:

- a piezoelectric sound generator composed of a piezoelectric membrane and a membrane suspension device;
- an acoustic unit comprising a compression chamber, an acoustic adaptation means and a radiant element;
- an electronic control circuit used to produce the signals required for functioning of the membrane, and
- a housing box comprising elements for mounting and electrically connecting the device.

The piezoelectric membrane of the invention is a membrane with a diameter of between 60 and 100 mm and has a main resonance peak in a frequency zone of between 350 and 500 Hz and a high vibration amplitude and its suspension has been designed so as to permit a large clearance for a stress and deformation minimum on the ceramic material.

The piezoelectric membrane of the invention, so as to produce a sufficient sound level, shall on vibration scan a certain volume at the time it vibrates. To this effect, the membrane shall bend but without reaching the minimum radius of curvature, above which the ceramic material breaks.

As this limiting radius of curvature is that much smaller when the ceramic material is thinner, according to the present invention it is therefore necessary to use the thinnest possible ceramic material which is compatible with the sought-after mechanical effect.

According to the invention, the suspension device of this membrane shall be designed so as to obtain from a ceramic material having a given limiting radius of curvature a scanning of the largest volume possible to this effect, the suspension of the membrane ought to be free and not embedded.

As mentioned above, the diameter of the membrane of the invention needs to be significantly larger than that of the membranes currently available on the market (50 mm) which is too small for reaching the required 120 decibels and the 400 Hz. Therefore, the diameter of the membranes is increased, which does not necessarily result in increasing the diameter of ceramic pellets.

So as to resolve this drawback, the invention suggests embodying the piezoelectric membrane in the form of a large diameter, such as about 9 cm, metallic membrane equipped at its center with a smaller, such as between 3 and 5 cm, ceramic pellet.

When applying an electric voltage to this membrane, the portion situated at the right of the ceramic material undergoes a spherical cap deformation, whereas the rest of the membrane tends to dampen the deformation by taking a curve contrary to that of the spherical cap. Now, so as to obtain maximum efficiency, it is essential that the rest of the membrane takes the shape of a cone trunk tangent to the spherical cap.

To this effect, it is essential that the piezoelectric membrane is as regards its outer portion (not covered by the ceramic material) both rigid in a radial direction and flexible in a diametrical direction so as to be able to deform solely into a <<tulip>> or even an <<umbrella>>. At the same time, the central portion of the membrane on which the ceramic material is glued needs to retain its isotropic elastic properties.

According to the invention, this deformation is obtained by starting with a flexible membrane on which rigid elements are grafted disposed along the rays like of the strips of an umbrella. These elements can be built on elements (like umbrella strips) or even folds or ribs disposed along the rays of the membrane. These elements are disposed in the shape of a ring at the periphery of the membrane from the outer edge to the limit of the zone covered by the ceramic material so as to retain at the central portion of the membrane the ability to warp into a <<spherical cap>>. The membrane needs to be extremely flexible between the stiffening elements.

One preferred embodiment of this membrane of the invention includes a molded rubber membrane on which a metallic membrane with the shape of a daisy is glued. Glued at the center of this daisy-shaped membrane is the piezoelectric ceramic pellet. It is possible to dispose in the axis of each daisy petal a stiffener, such as a fold, which slightly occupies the central portion so that, at the time this central portion is deformed, these stiffeners are positioned along a tangent line to the spherical portion.

The outer shape of said rubber membrane is preferably shaped so as to create waves aimed at providing a maximum flexibility to the fixing of the membrane, both on bending as on extension. The created waves also have the effect of distributing the stresses and thus the fatigue of the rubber over a larger surface, thus resulting in conferring a longer period of life.

In one variant of this embodiment, the <<daisy>> membrane can be embodied in tow portions, namely a central homogeneous metal portion lined with a crown of stiffeners, not necessarily metallic, and able to be obtained by the molding of a plastic material.

Without departing from the context of the invention, it is possible to use a textile impregnated instead of rubber. However, the use of molded rubber makes it possible to in-mold in the body of the membrane the electric conductors required to electrically feeding the piezoelectric membrane.

Equally, without departing from the context of the invention, it is possible to use a flexible plastic material (such as PVC or mylar) whilst retaining the advantages of the rubber.

The rubber portion of the membrane could also be glued onto the same side of the metallic membrane as the piezoelectric pellet. As the rubber membrane has been obtained by molding, it would be a simple matter to fit the place available to achieve this.

In addition, the taking of contact on the piezoelectric pellet would be rendered easier as this contact could be made fully in-molded.

This taking of contact system makes it possible to also inexpensively connect a second smaller electrode situated on the ceramic pellet. This second electrode, along with the sub-jacent ceramic material, constitutes a piezoelectric sensor providing an electric voltage which varies with the movement of the membrane. This voltage is used in the electronic control circuit so as to automatically control the control frequency so that it is automatically tuned to the resonance frequency of the membrane. In this way and without any need for adjustment, a maximum sound level can be obtained.

A further role of the rubber portion of the membrane of the invention consists of ensuring the imperviousness of the horn, a suitable shape being to this effect fitted at the extremity of the waves of the membrane.

According to another embodiment of the invention, so as to enrich the emitted sound spectrum, a rectangular membrane is used with rounded comers or even an elliptic membrane or more generally one having the shape of a surface characterized by two main dimensions being expressed by the existence of at least two main resonance frequencies.

So as to provide a sound which is both powerful and agreeable, the invention provides using as an acoustic adaptation element a Helmholtz cavity resonator or even a wound or folded back exponential horn, the choice being made so as to obtain, depending on the diameter of the retained membrane, the best possible compromise between the quality of the sound and the spatial requirement.

The control circuit, preferably of the type with advanced integration, has been designed so as to provide a high control voltage of about one hundred volts. A variety of control modes is then possible ranging from control by a sinusoidal alternation through a transformer to high voltage systems with short pulses produced by capacitive switching.

According to the invention, it would be advisable to adapt the membrane to the signal delivered by the control circuit and this adaptation can be effected as follows:

When the selected control circuit delivers a symmetrical wave form (alternate voltage or even with a nil mean value), it is preferable to use a membrane whose central portion supporting the ceramic material is flat in fact, the symmetrical wave forms shall stress the membrane alternately in one direction and then in the other.

In this way, the deformation of the membrane shall be symmetrical on both sides of its rest plane for a given limiting radius of curvature, it is thus possible to have an amplitude with maximum clearance.

On the other hand, it is often less expensive to embody control circuits delivering electric pulses with a single polarity. In this case, the membrane is only stressed in one direction, and if a flat membrane is used, the permitted clearance amplitude for a given radius of curvature shall be half that obtained by a symmetrical wave form it is advantageous in this case to select a membrane shape already deformed at rest so that after polarization and in the absence of any electric stressing, the radius of curvature of the ceramic material is close to the permissible minimum the electric control pulses shall then be applied so as to provoke a deformation which is antagonist with respect to the initial deformation. In this way, for a given limiting radius of curvature of the ceramic material, by using control pulses with a single polarity, it is possible to obtain the same vibration amplitude as with symmetrical pulses.

BRIEF DESCRIPTION OF THE DRAWINGS

So as to clearly understand the piezoelectric horn of the present invention, there follows hereafter by way of non-restrictive example a description of a preferred embodiment with reference to the accompanying diagrammatic drawing on which.

DETAILED DESCRIPTION OF THE PREFERRED EMBODIMENTS

Figure 1:
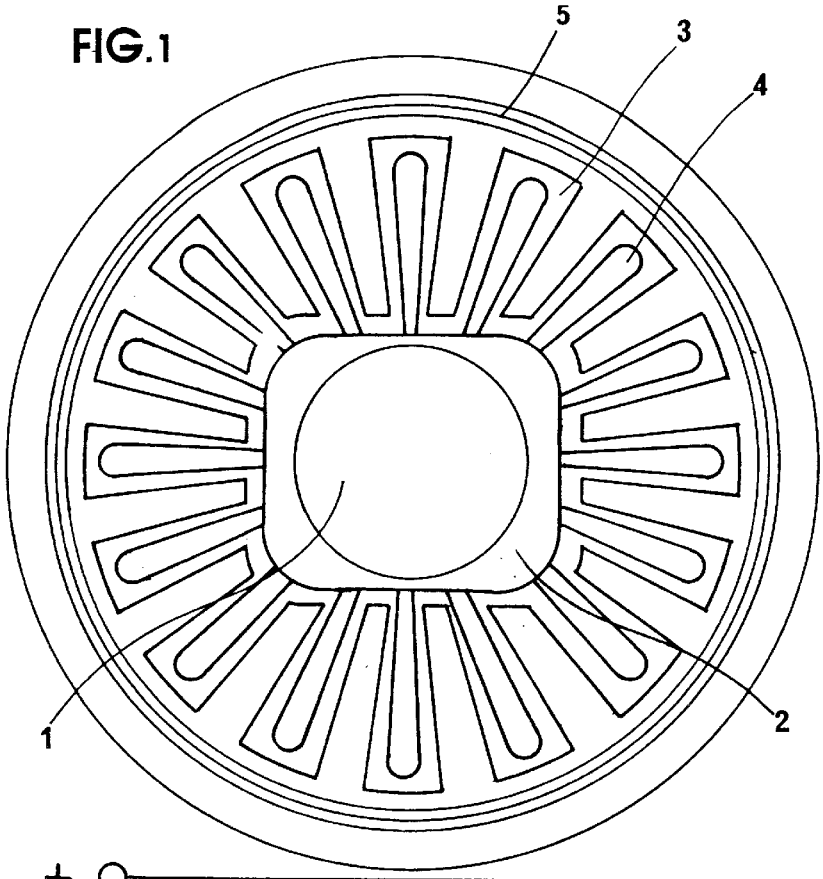
FIG. 1 is a front view of the piezoelectric membrane equipping the sound horn of the invention.
Figure 2:
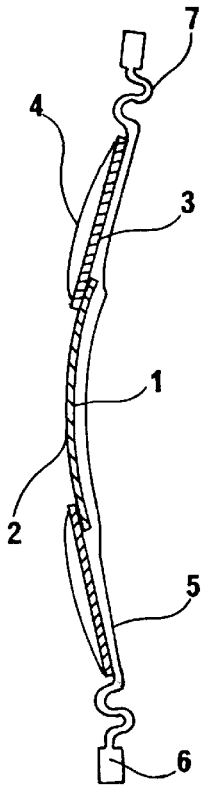
FIG. 2 is a cutaway view of the membrane of FIG. 1.

With reference to FIGS. 1 and 2, these show at 1 a ceramic disk glued to a metallic plate 2 having the shape of a rectangle with rounded corners. The metal of the plate 2 is preferably brass or an alloy possessing good elasticity. Depending on the effect sought-after, the ratio between the length and width of the plate 2 is between 1.1 and 1.5.

A light metal annular structure 3 with the shape of a notched crown is rigidly fixed (by brazing or gluing) to the periphery of the plate 2. The outer portion of the crown 3 comprises sixteen fingers disposed radially and distributed uniformly over the circumference. These fingers are fitted along their axis with a boss 4 embodied by means of drawing. These bosses 4 act as stiffeners, thus preventing the fingers from warping.

According to one variant (not shown on the drawing), the annular structure 3 could also be made of a rigid plastic material, the bosses 4 then being replaced by edges.

According to another variant, both the plate 2 and the structure 3 can be made up of a single metallic element by means of cutting and cold stamping.

When the ceramic material 1 is assembled on the plate 2, a slight deformation is applied to both of these elements so that once the assembling has been embodied and the ceramic material polarized, the central portion is deformed along a spherical cap whose radius of curvature is slightly larger than the minimum radius of curvature supported by the ceramic material. On FIG. 2, this curve has been deliberately exaggerated for providing improved clarity of the drawing.

The entire membrane comprising the ceramic material 1, the metallic plate 2 and the stiffening crown 3 are then secured to a molded rubber membrane 5. This circular membrane 5, so as to render mounting of the horns easier, comprises a thick outer portion 6 with a rectangular section forming a field splice.

The membrane 5 also comprises a wave-shaped softened portion 7 intended to permit the free clearance of the central portion of the device. The central portion of the membrane 5 comprises as-molded reserves permitting housing of the ceramic material 1 and the plate 2 if need be.

Embedded in the thickness of the rubber of the membrane 5 are two thin metallic strips (not shown) disposed in such a way as to establish an electric contact with respectively the pellet of the ceramic material I and the metallic plate 2. These two strips are flush with the level of the portion forming the joint of the membrane 5 at a location where the latter is fixed. This disposition makes it possible to eliminate a weak point of the conventional piezoelectric sound transducers, that is the taking of electric contact on the moving ceramic material.

By means of this placing in contact technique, it is preferable to use a ceramic material with two electrodes allowing for less expensive automatic control of the excitation frequency.

Figure 3:
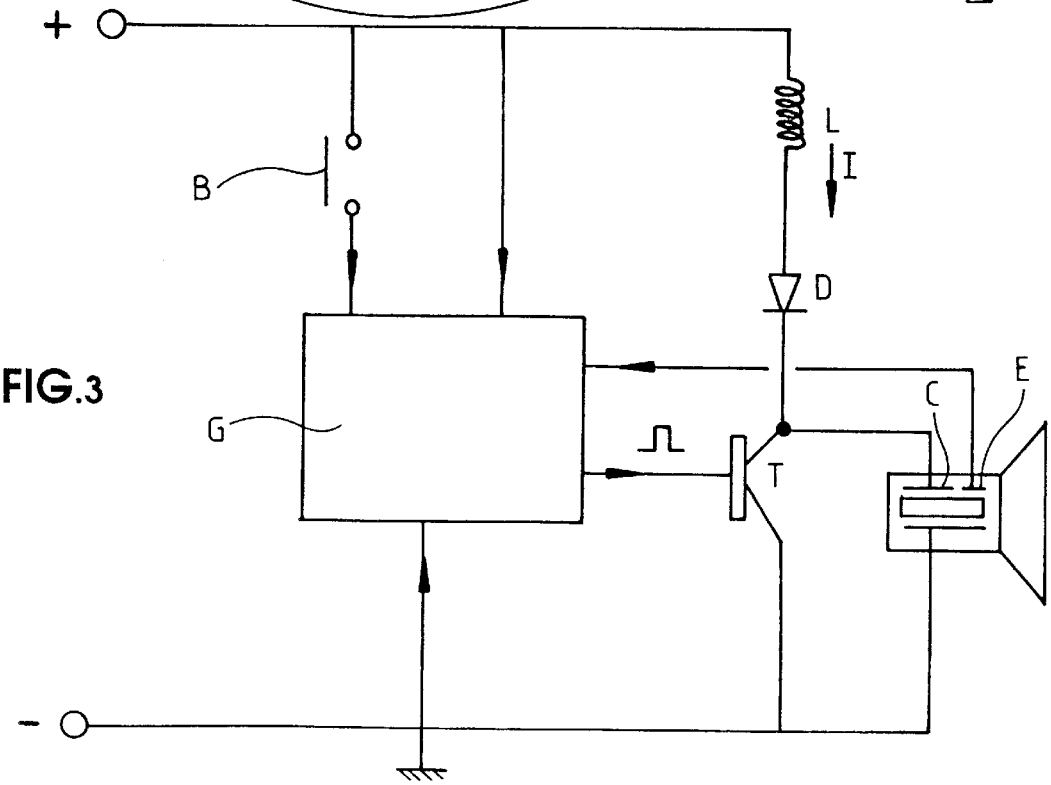
FIG. 3 is a diagrammatic view of the control circuit of the piezoelectric horn.

FIG. 3 shows a control circuit for a piezoelectric horn according to the invention.

This control circuit has been designed to be as inexpensive as possible. It comprises a modified 'flyback' type high voltage generator.

At the time of activating control B of the horn, a generating integrated circuit with a frequency C supplies to the base of a transistor T positive pulses which place the latter on conduction, which has the effect of:

firstly discharging the capacitor C formed by the piezoelectric ceramic material, secondly establishing in the inductance coil L a current I which linearly increases over a period of time.

At the end of the control pulse, the transistor T is locked and the energy stored in the coil L is transferred passing through a diode D in series with the coil L into the capacitor C formed by the piezoelectric membrane. The diode D then prevents the capacitor from discharging itself in the coil L.

The second electrode E of the membrane, as seen earlier, provides to the integrated circuit G a counter-reaction voltage which makes it possible to automatically control the frequency of the control pulses it provides on the frequency giving the amplitude maximum to the movement of the membrane.

Figure 4:
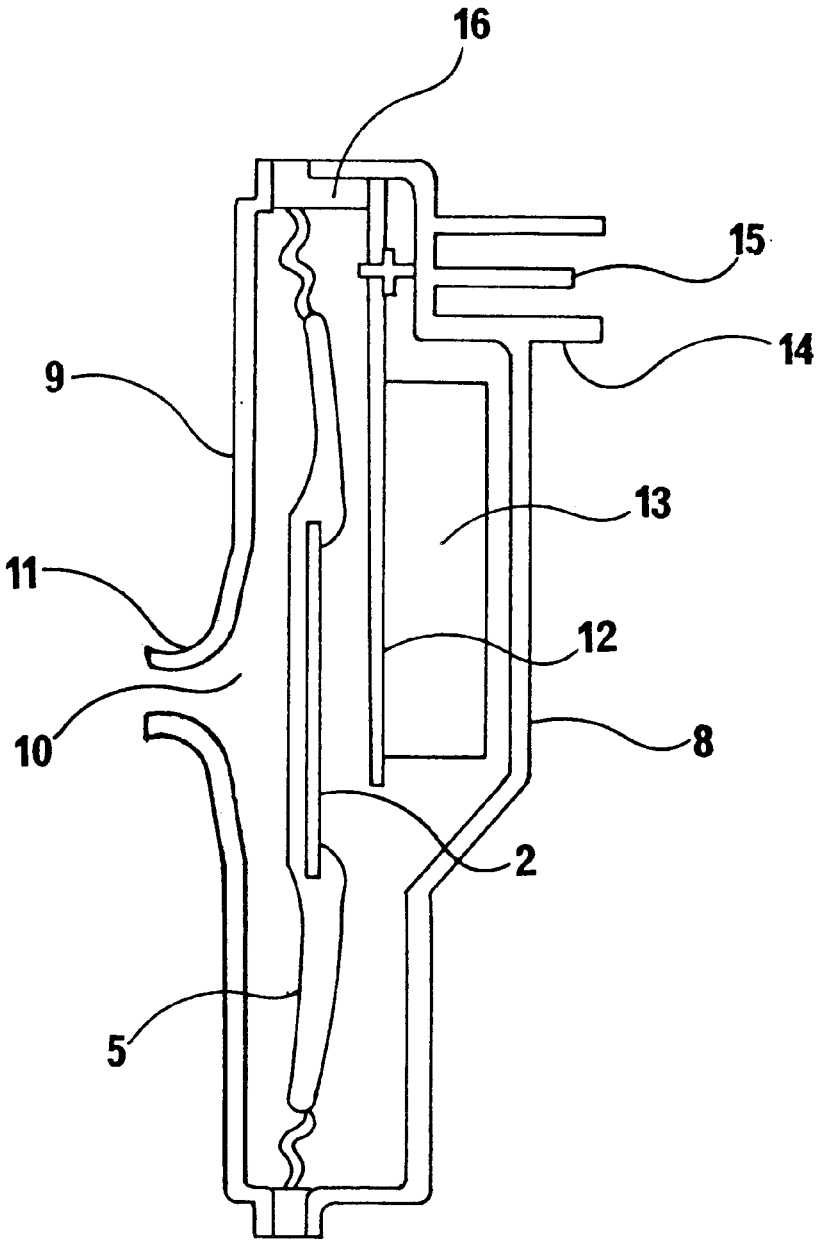
FIG. 4 is a vertical sectional view of the horn after mounting of the piezoelectric membrane and the control circuit.

FIG. 4 shows the traditional construction of the sound horn using the membrane represented on FIGS. 1 and 2. The membrane 5 is mounted between a box 8 and a plate 9, both being made of plastic. The space 10 between the membrane 5 and the plate 9 determines a compression chamber whose central vent 11 communicates with the center of an acoustic horn, as shall be seen on FIGS. 5 and 6.

The control circuit described on detail on FIG. 3 is mounted on a printed plate 12 which comprises all the electronic components shown on the diagram at 13. The connection with the outside world is effected by a connector 14 molded in the box 8 whose blades 15 are mounted directly on the printed circuit.

The connecting of the electrodes of the membrane is made by metallic strips in-molded in the membrane 5 and which have been described earlier. These strips come out of the membrane at the level of a protuberance 16 which makes it possible to establish contact by means of pressure at the time of mounting.

The horn is completed by a dome which includes a right section portion used for acoustic tuning, and an exponential portion.

Figure 5:
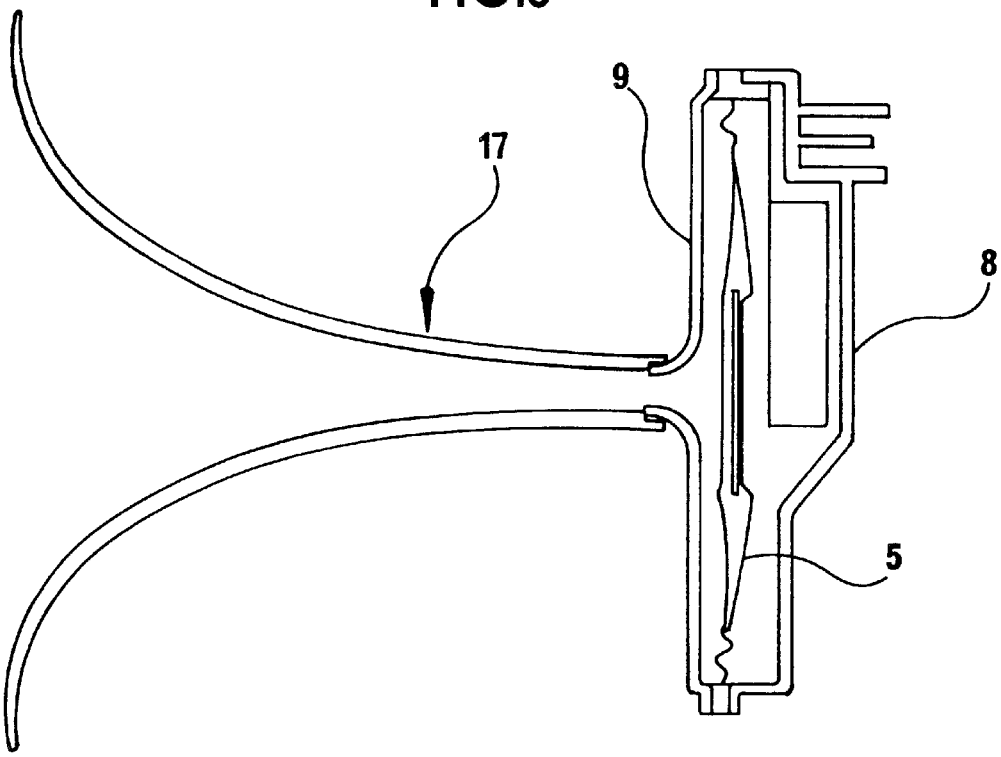
FIGS. 5 and 6 are views of the horn of FIG. 4 and equipped respectively with a straight dome and a standard wound dome.
Figure 6:
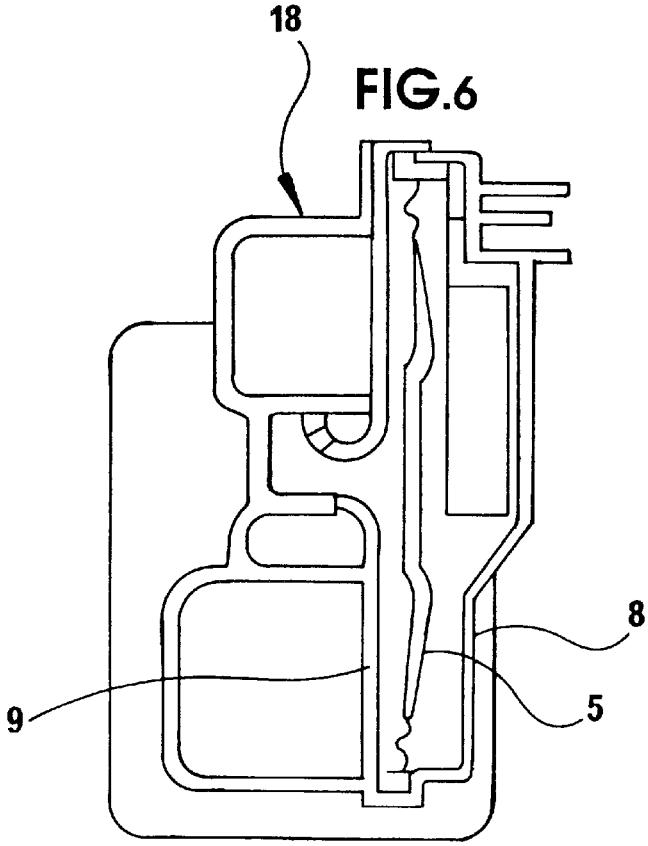

The dome 17 may be straight for horns for intensive usage as shown on FIG. 5, but the dome shall preferably of the wound type as on conventional horns as shown at 18 on FIG. 6.

It can be readily understood that the above description has been given merely by way of non-restrictive example and constructive modifications or additions could be made without departing from the context of the invention.

What is claimed is:

1. A piezoelectric sound horn which comprises:

a piezoelectric sound generator consisting of a piezoelectric membrane, said piezoelectric membrane comprising:

a large diameter metal membrane, a ceramic pullet of a smaller diameter than said metal membrane, said ceramic pullet being disposed in a center-part of said metal membrane, said piezoelectric membrane bearing rigid elements acting as stiffeners, said rigid elements being disposed along rays of the piezoelectric membrane so that a part of the piezoelectric membrane not covered by said ceramic pullet is both rigid in a radial direction and flexible in a diametral direction, an acoustic unit comprising:

adaptation means, a radiation element, said acoustic unit determining along with a suspension device of said piezoelectric membrane a compression chamber; and an electronic control circuit providing said piezoelectric membrane with high voltage signals and a frequency required for the functioning thereof.

2. Horn according to claim 1, wherein said stiffeners are mounted on said piezoelectric membrane.

3. Horn according to claim 1, wherein said stiffeners are folds of the said piezo-electric membrane.

4. Horn according to claim 1, wherein said stiffeners extend from the outer edge of said piezo-electric membrane up to the zone covered by the ceramic pellet.

5. Horn according to claim 1, wherein the piezoelectric membrane includes a molded rubber membrane on which a metallic daisy-shaped membrane is glued, the ceramic pellet being glued at the center of said daisy-shaped membrane, and the stiffeners being disposed in the axis of each petal of the daisy.

6. Horn according to claim 5, wherein said rubber membrane is shaped so as to form waves.

7. Horn according to claim 5, wherein the metallic daisy-shaped membrane is constituted by a central metal portion and by a crown of stiffeners.

8. Horn according to claim 5, wherein the rubber membrane is glued on a same side of the metallic daisy-shaped membrane as the ceramic pellet said rubber membrane thus presenting on molding a housing for the ceramic pellet.

9. Horn according to claim 8, wherein an electrode is totally excess-molded in the rubber membrane, said electrode allowing a contact with said ceramic pellet.

10. Horn according to claim 1, wherein the piezoelectric membrane has a main resonance frequency situated in a 400 Hz zone.

11. Sound horn according to claim 1, wherein the control circuit includes a modified <<flyback>> type high voltage generator comprising a diode mounted in series with a coil so as to prevent at the end of control pulse applied to the base of a transistor of said control circuit, a capacitor formed by the piezoelectric membrane from discharging itself in a coil.

* * * * *